US008602691B1

(12) United States Patent
Hilfiker

(10) Patent No.: US 8,602,691 B1
(45) Date of Patent: Dec. 10, 2013

(54) LOCKING MECHANISM

(76) Inventor: William B. Hilfiker, Fortuna, CA (US)

( * ) Notice: Subject to any disclaimer, the term of this patent is extended or adjusted under 35 U.S.C. 154(b) by 7 days.

(21) Appl. No.: 13/485,673

(22) Filed: May 31, 2012

(51) Int. Cl.
*E21D 21/00* (2006.01)

(52) U.S. Cl.
USPC ..... 405/262; 405/284

(58) Field of Classification Search
USPC ..... 405/262, 284, 285, 286, 288
See application file for complete search history.

(56) References Cited

U.S. PATENT DOCUMENTS 4,564,316 A * 1/1986 Hunziker ..... 405/262
5,921,715 A * 7/1999 Rainey ..... 405/262
6,024,516 A * 2/2000 Taylor et al. ..... 405/262
6,874,975 B2 4/2005 Hilfiker et al.
7,377,725 B2 * 5/2008 Cammack ..... 405/284

* cited by examiner

*Primary Examiner* — Benjamin Fiorello
(74) *Attorney, Agent, or Firm* — Eric Karich

(57) ABSTRACT

A locking mechanism has a pilaster, a spiralnail, a locking ring, and a cam plate. The pilaster has an elongate pilaster body that has edge walls, a nail hole, and a bolt slot adjacent the nail hole. The locking ring includes a nail engaging aperture having a perimeter shaped to receive and lockingly engage the spiralnail. The cam plate has a second bolt hole and a torque application element. A bolt is positioned through the bolt slot of the pilaster, through the first bolt hole of the locking ring, and through the second bolt hole of the cam plate. The torque application element may be used to rotate the cam plate so that a cam-shaped outer perimeter contacts one of the edge walls of the pilaster and acts as a lever to rotate the locking ring and apply torque to the spiralnail.

6 Claims, 3 Drawing Sheets

LOCKING MECHANISM

BACKGROUND OF THE INVENTION

1. Field of the Invention

This invention relates generally to the construction of retaining walls, and more particularly to a locking mechanism for locking a spiralnail used in constructing a retaining wall.

2. Description of Related Art

The following art defines the present state of this field:

Hilfiker et al., U.S. Pat. No. 6,874,975, teaches a soil reinforced retaining wall for an earthen embankment which is formed by driving nails into the embankment at spaced intervals. The nails have helical threads extending there-around of such proportion and pitch as to screw into the formation as the nails are driven into place with a vibratory hammer, without prior boring of the embankment to accommodate the nails, or the necessity of cementing the nails into place. The wall is constructed from the top down and face panels are progressively assembled over the embankment and secured in place by the nails. This patent is hereby incorporated by reference in full.

The prior art teaches an apparatus and method for constructing soil reinforced earthen retaining walls, such as is described above. However, the prior art does not teach a cam locking assembly for locking the spiralnails in place during the construction of retaining walls. The present invention fulfills these needs and provides further related advantages as described in the following summary.

SUMMARY OF THE INVENTION

The present invention teaches certain benefits in construction and use which give rise to the objectives described below.

The present invention provides a locking mechanism for locking a spiralnail used in a retaining wall system. The locking mechanism has a pilaster, a locking ring, and a cam plate. The pilaster has an elongate pilaster body that has a front surface and edge walls extending outwardly from the front surface. A nail hole through the elongate pilaster body is shaped to receive the spiralnail therethrough, and a bolt slot through the elongate pilaster body is adjacent the nail hole. The locking ring includes opposed surfaces that extend to a perimeter, and has a nail engaging aperture and a first bolt hole therethrough. The nail engaging aperture has a perimeter shaped to receive the spiralnail therethrough and lockingly engage the spiralnail. The cam plate has opposed surfaces that extend to a cam-shaped outer perimeter, a second bolt hole, and a torque application element. A bolt is positioned through the bolt slot of the pilaster, through the first bolt hole of the locking ring, and through the second bolt hole of the cam plate. A nut is operably engaged with the bolt to tighten the cam plate and the locking ring against the pilaster, whereby the torque application element may be used to rotate the cam plate so that the cam-shaped outer perimeter contacts one of the edge walls of the pilaster and acts as a lever to rotate the locking ring and apply torque to the spiralnail.

A primary objective of the present invention is to provide a locking mechanism having advantages not taught by the prior art.

Another objective is to provide a locking mechanism for locking a spiralnail within a pilaster and tensioning the spiralnail using the cam plate to torque specifications.

A further objective is to provide a locking mechanism that is quick and easy to install.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a locking mechanism 10 for locking a spiralnail 12 with a pilaster 14 used in a retaining wall system 16.

Figure 1:
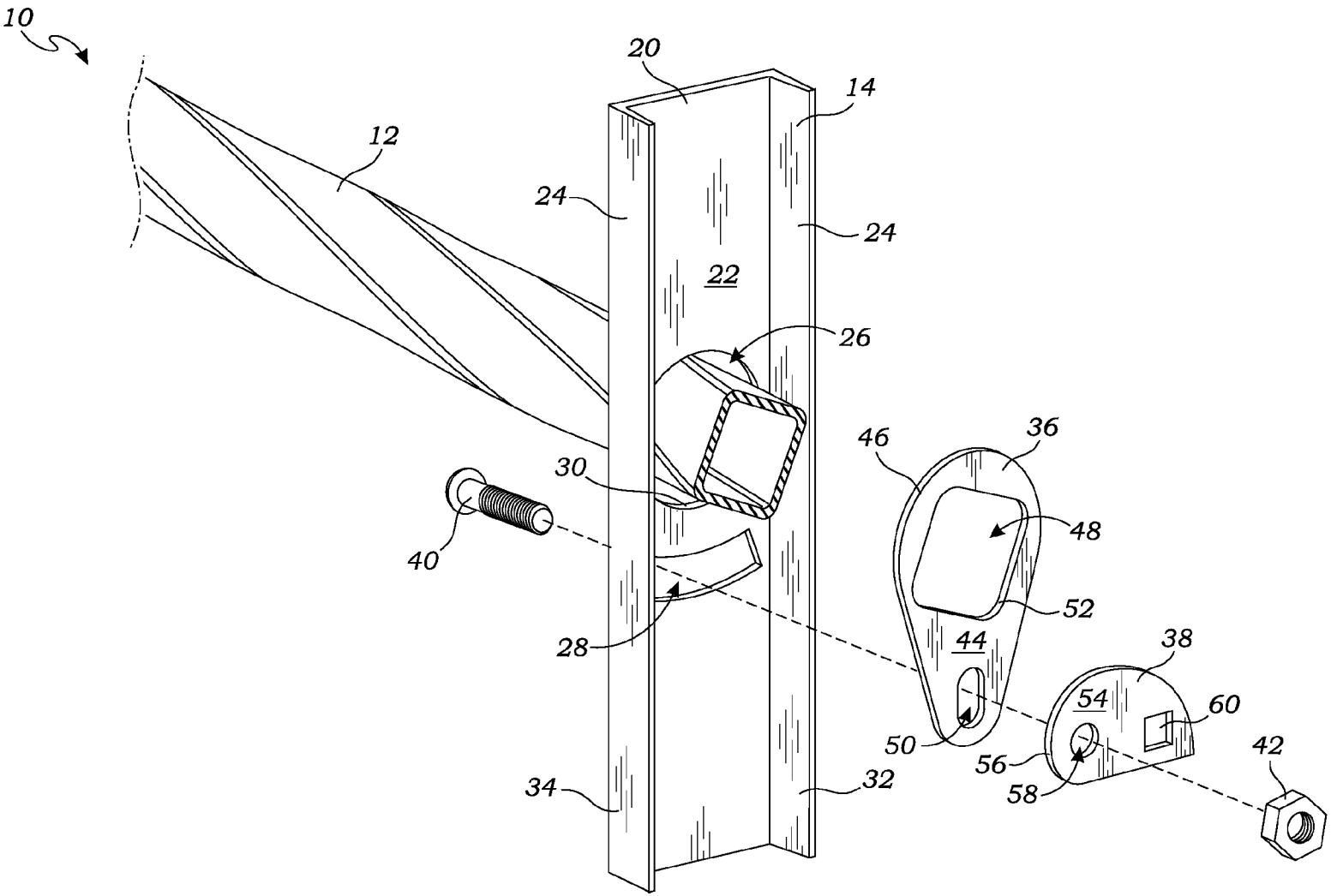
FIG. 1 is a perspective view of a locking mechanism according to one embodiment of the present invention, illustrating a spiralnail, a pilaster, and the locking mechanism.
Figure 2:
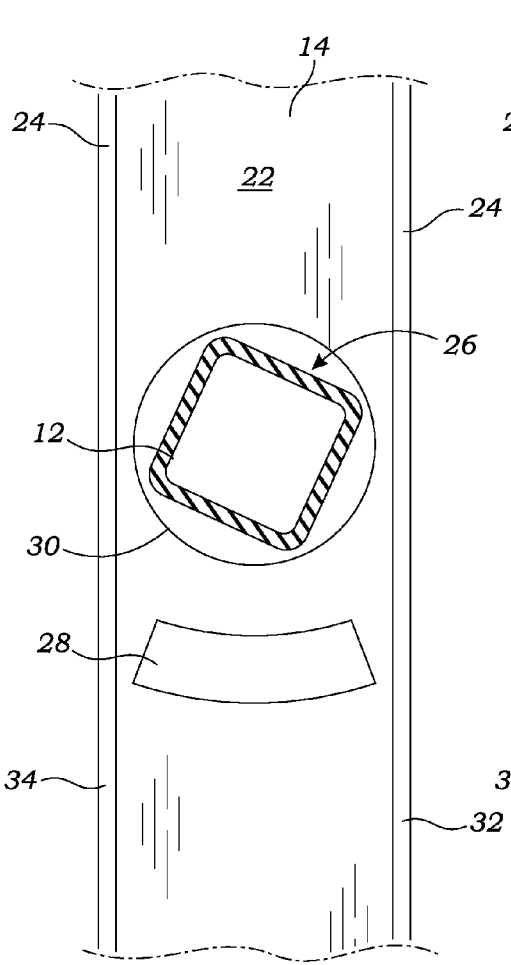
FIG. 2 is a front elevational view of the spiralnail and the pilaster.

FIG. 1 is a perspective view of the locking mechanism 10 according to one embodiment of the present invention. FIG. 2 is a front elevational view of the spiralnail 12 and the pilaster 14. As illustrated in FIGS. 1 and 2, the pilaster 14 is shaped to receive the spiralnail 12 and provide support for the retaining wall system 16. In the embodiment of FIGS. 1 and 2, the pilaster 14 is a vertically extending column that is generally rectangular in shape. The pilaster 14 includes an elongate pilaster body 20, a front surface 22, and edge walls 24. The elongate pilaster body 20 may include a nail hole 26 which is shaped to receive the spiralnail 12 therethrough, as well as a bolt slot 28 adjacent the nail hole 26. In the present embodiment of FIGS. 1 and 2, the nail hole 26 has a curved perimeter 30 and the bolt slot 28 is also curved in order to match the curved perimeter 30 of the nail hole 26.

In this embodiment, the edge walls 24 of the elongate pilaster body 20 extend outwardly from the front surface 22 to form a right side 32 and a left side 34 of the pilaster 14. The pilaster 14 of FIGS. 1 and 2 may be constructed out of a sturdy material, such as steel, so as to prevent buckling, bending, or other structural damage to the retaining wall system 16. While FIGS. 1 and 2 illustrate on embodiment of the pilaster 14, those skilled in the art may devise alternative embodiments, and these alternative or equivalent designs are considered within the scope of this present invention.

As shown in FIGS. 1 and 2, the locking mechanism 10 includes a locking ring 36, a cam plate 38, a bolt 40, and a nut 42. The locking ring 36 of FIG. 1 fits onto and interlocks with the spiralnail 12. The locking ring 36 may include opposed surfaces 44 that extend to a perimeter 46, and provide a nail engaging aperture 48 and a first bolt hole 50. The opposed surfaces 44 of the locking ring 36 terminate at the perimeter 46, or edge, and may form a disc-like shape. As illustrated in FIG. 1, the nail engaging aperture 48 is located adjacent the first bolt hole 50 and has a perimeter 52 shaped to receive the spiralnail 12 therethrough in order to lockingly engage the spiralnail 12. The first bolt hole 50 may be an elongate shape (e.g., an oval or an ellipse) as a means to facilitate the installation of the locking mechanism 10, as described below. The locking ring 36 may be formed out of any strong and durable material, such as steel, that is suitable to lock the spiralnail 12 in place. Although FIG. 1 illustrates one embodiment of the locking ring 36, alternative embodiments may be designed by one skilled in the art and are therefore considered within the scope of the present discussion.

As illustrated in FIG. 1, the cam plate 38 of the locking mechanism 10 is used to rotate the locking ring 36, to lock and maintain a torque against the spiralnail 12. In the embodiment of FIG. 1, the cam plate 38 includes opposed surfaces 54 that extend to a cam-shaped outer perimeter 56, a second bolt hole 58, and a torque application element 60. The second bolt hole 58 of the cam plate 38 is formed through the opposed surfaces 54 that extend to the cam-shaped outer perimeter 56. The torque application element 60 of FIG. 1 may be a drive aperture through which a driver (not shown) may be inserted to increase torque and rotate the cam plate 38. In doing so, the cam-shaped outer perimeter 56 may contact one of the edge walls 24 of the pilaster 14 and acts as a lever to rotate the locking ring 36 and apply torque to the spiralnail 12. However, while FIG. 1 illustrates one embodiment of the cam plate 38, alternative embodiments deemed suitable by those skilled in the art are considered to be within the scope of the present invention.

The bolt 40 and the nut 42, illustrated in FIG. 1, are used to mount the locking ring 36 and the cam plate 38 on the pilaster 14. The bolt 40 is positioned through the bolt slot 28 of the pilaster 14, through the first bolt hole 50 of the locking ring 36, and then through the second bolt hole 58 of the cam plate 38. The nut 42 operably engages with the bolt 40 to tighten the cam plate 38 and the locking ring 36 against the pilaster 14. In the embodiment of FIG. 1, the bolt 40 and nut 42 are of standard construction well known in the art; however, those skilled in the art may devise alternative embodiments which are still considered within the scope of the present invention.

Figure 3:
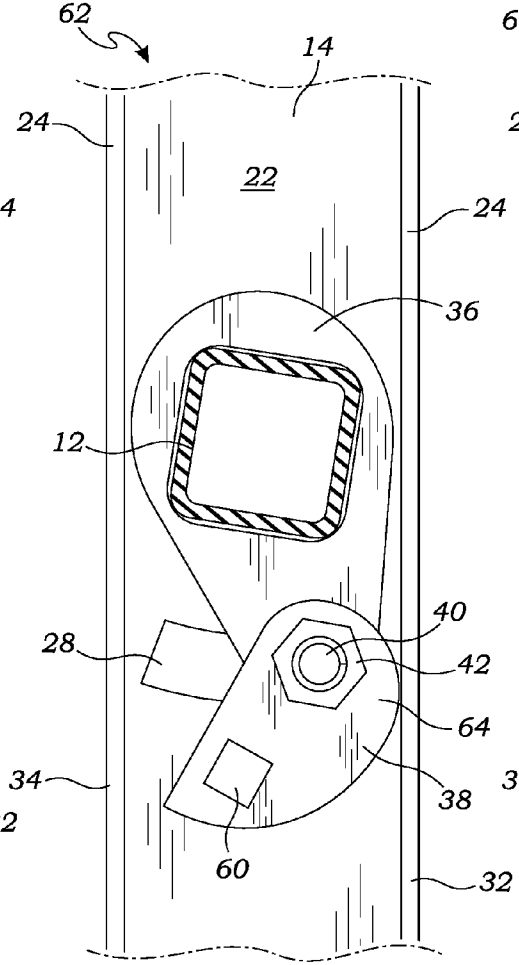
FIG. 3 is a front elevational view of the locking mechanism in an untorqued position.

FIG. 3 is a front elevational view of the locking mechanism 10 in an untorqued position 62. As shown in FIG. 3, when the locking mechanism 10 is assembled and the nut 42 is initially tightened, the bolt 40 and the nut 42 initially rotate counter-clockwise (in this embodiment) until a smaller-diameter portion 64 of the cam-shaped outer perimeter 56 abuts the edge wall 24 of the pilaster 14.

Figure 4:
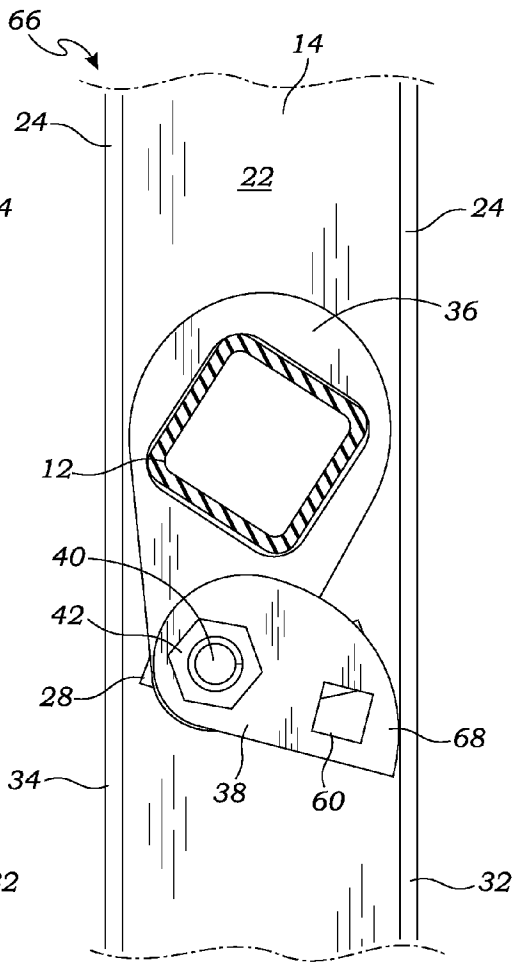
FIG. 4 is a front elevational view of the locking mechanism in a torqued position.

FIG. 4 is a front elevational view of the locking mechanism 10 in a torqued position 66. As illustrated in FIG. 4, once a driver (not shown) has been attached to the torque application element 60, it may be used to turn the cam plate 38 to the torqued position 66, wherein a larger-diameter portion 68 of the cam-shaped outer perimeter 56 abuts the edge wall 24 of the pilaster 14. This rotation turns the locking ring 36 and imparts a torque to the spiralnail 12. As a result, the spiralnail 12 is locked into position within the nail hole 26 of the pilaster 14, thus providing support and stability to the retaining wall system 16. Although FIG. 4 illustrates one embodiment of the torqued position 66 of the locking mechanism 10, those skilled in the art may devise alternative embodiments while still remaining within the scope of the present invention.

The invention also includes a method of using the locking mechanism 10, described above, for locking the spiralnail 12 in the retaining wall system 16. In this method, the spiralnail 12 may be inserted through the nail hole 26 in the pilaster 14, before being inserted through the nail engaging aperture 48 of the locking ring 36. The bolt 40 may then be inserted behind the pilaster 14 into the curved bolt slot 28 and through the first bolt hole 50 in the locking ring 36. The bolt 40 may then be threaded through the second bolt hole 58 of the cam plate 38. These elements may then be tightened by the nut 42 and pressed against the front surface 22 of the pilaster 14. One may finger tighten the nut 42 and rotate the cam plate 38 counter-clockwise to lock against the right side 32 of the pilaster 14. Torque may then be applied to the drive aperture 60 in the cam plate 38 in order to rotate to the right side 32 of the pilaster 14. In doing so, the cam-shaped outer perimeter 56 may contact one of the edge walls 24 of the pilaster 14 and acts as a lever to rotate the locking ring 36 and apply torque to the spiralnail 12. Once in the torqued position 66, the spiralnail 12 is locked into place within the pilaster 14, to provide support to the entire retaining wall system 16.

Figure 5:
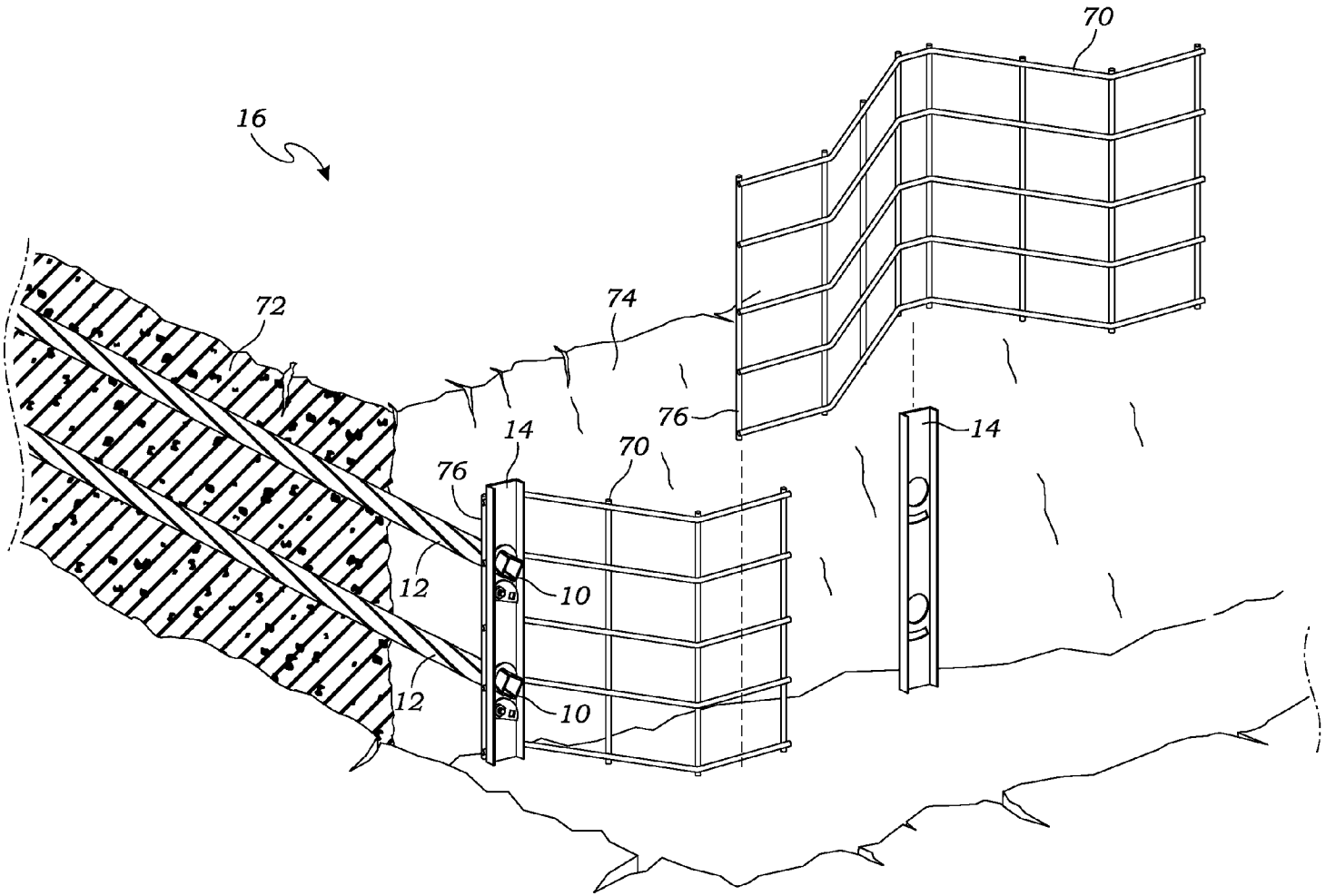
FIG. 5 is a perspective view of a retaining wall system using the locking mechanism.

FIG. 5 is a perspective view of the retaining wall system 16, illustrating the locking mechanism 10 as applied to spiralnails 12 in the pilaster 14 of a truss 70. As illustrated in FIG. 5, the retaining wall system 16 is constructed to resist the lateral pressure of soil 72 in order to stabilize an earthen embankment 74 (e.g., embankment, hillside, or other formation that might require stabilization). The truss 70 includes an edge 76 that may be positioned against the pilaster 14 before the spiralnail 12 is inserted through the pilaster 14, driven into the earthen embankment 74, and locked by the locking mechanism 10, as previously described herein. Thus, the locking mechanism 10 provides a means by which the spiralnail 12 may be locked in place and anchored in the ground, thereby securing the truss 70 and preventing soil 72 from sliding past the retaining wall system 16. While FIG. 5 illustrates one embodiment of the retaining wall system 16, alternative embodiments designed by one skilled in the field are considered within the scope of the present invention.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A locking mechanism for locking a spiralnail used in a retaining wall system, the locking mechanism comprising:

a pilaster having an elongate pilaster body having a front surface and edge walls extending outwardly from the front surface;

a nail hole through the elongate pilaster body shaped to receive the spiralnail therethrough;

a bolt slot through the elongate pilaster body adjacent the nail hole;

a locking ring that includes opposed surfaces that extend to a perimeter, the locking ring having a nail engaging aperture and a first bolt hole therethrough, the nail engaging aperture having a perimeter shaped to receive the spiralnail therethrough and lockingly engage the spiralnail;

a cam plate having opposed surfaces that extend to a cam-shaped outer perimeter, the cam plate having a second bolt hole and a torque application element;

a bolt positioned through the bolt slot of the pilaster, through the first bolt hole of the locking ring, and through the second bolt hole of the cam plate; and a nut operably engages with the bolt to tighten the cam plate and the locking ring against the pilaster, whereby the torque application element may be used to rotate the cam plate so that the cam-shaped outer perimeter contacts one of the edge walls of the pilaster and acts as a lever to rotate the locking ring and apply torque to the spiralnail.

2. The locking mechanism of claim 1, wherein the nail hole has a curved perimeter, and wherein the bolt slot is curved to match the curved perimeter of the nail hole.

3. The locking mechanism of claim 1, wherein the torque application element is a drive aperture.

4. The locking mechanism of claim 1, wherein the first bolt hole of the locking ring is in the shape of an ellipse.

5. A method for a locking a spiralnail in a retaining wall system by means of a locking mechanism, the method comprising the steps of:

positioning the spiralnail through a nail hole in a pilaster and through a nail engaging aperture in a locking ring;

inserting a bolt behind the pilaster into a curved slot, through a first bolt hole in the locking ring, and threading the bolt through a second bolt hole of a cam plate;

tightening the locking ring and the cam plate against the pilaster with a nut;

rotating the cam plate counter-clockwise to lock against the pilaster;

applying torque to a drive aperture in the cam plate, such that a cam-shaped outer perimeter may contact an edge wall of the pilaster and act as a lever to rotate the locking ring and apply torque to the spiralnail; and locking the spiralnail into position within the pilaster, to stabilize the retaining wall system.

6. A method for installing a retaining wall system on an earthen embankment, the method comprising the steps of:

driving a spiralnail into the earthen embankment;

positioning the spiralnail through a nail hole in a pilaster;

positioning a locking ring around the spiralnail such that the spiralnail fits through a nail engaging aperture in the locking ring;

inserting a bolt through a curved slot of the pilaster, through a first bolt hole in the locking ring, and threading the bolt through a second bolt hole of a cam plate;

tightening the locking ring and the cam plate against the pilaster with a nut;

rotating the cam plate counter-clockwise to lock against the pilaster; and applying torque to a drive aperture in the cam plate, such that a cam-shaped outer perimeter may contact an edge wall of the pilaster and act as a lever to rotate the locking ring and apply torque to the spiralnail, thereby locking the spiralnail with respect to the pilaster.

* * * * *